United States Patent [19]

Kim

[11] Patent Number: 4,545,775

[45] Date of Patent: Oct. 8, 1985

[54] DANCING HULA DOLL

[76] Inventor: Douglas S. T. Kim, 1350 Ala Moana Blvd., #403, Honolulu, Hi. 96814

[21] Appl. No.: 651,514

[22] Filed: Sep. 17, 1984

[30] Foreign Application Priority Data

Mar. 30, 1984 [KR] Rep. of Korea ..... 2801/1984

[51] Int. Cl.[4] ..... A63H 3/28; A63H 11/00

[52] U.S. Cl. ..... 446/299; 446/297; 446/353

[58] Field of Search ..... 446/190, 297, 298, 302, 446/303, 322, 330, 352, 353, 354, 358, 265, 299, 300; 84/94, 94 C, 95, 95 C

[56] References Cited

U.S. PATENT DOCUMENTS

| | | | |
|---|---|---|---|
| Re. 6,875 | 1/1876 | La Grove . | |
| 1,272,516 | 7/1918 | Pelto | 446/265 |
| 1,422,855 | 7/1922 | Haskell | 446/353 |
| 1,423,383 | 7/1922 | Zaiden . | |
| 1,430,811 | 10/1922 | Johnson et al. | 446/302 X |
| 1,452,134 | 4/1923 | Zaiden . | |
| 2,526,886 | 10/1950 | MacDonald | 446/358 |
| 2,637,936 | 5/1953 | Dale et al. | 446/236 X |
| 2,691,845 | 10/1954 | Jepson | 46/120 |
| 2,807,118 | 9/1957 | Reuge | 446/303 |
| 2,958,144 | 11/1960 | Stranges et al. | 446/236 X |
| 3,672,097 | 6/1972 | Gardel et al. | 46/120 |
| 3,834,071 | 9/1974 | Terzian et al. | 46/120 |
| 4,040,206 | 8/1977 | Kimura | 46/138 |

FOREIGN PATENT DOCUMENTS 666207 2/1952 United Kingdom .

*Primary Examiner*—Robert A. Hafer
*Assistant Examiner*—D. Neal Muir
*Attorney, Agent, or Firm*—Fleit, Jacobson, Cohn & Price

[57] ABSTRACT

A dancing hula doll which alternatively moves its hips left and right to give it a lifelikeness that compares with a real hula dancer. The doll includes an upper portion, a lower portion, and a base portion. The upper portion resembles and head through waist of a human; the lower portion resembles the waist through hip portion of a human. The upper portion is pivotally connected to the lower portion by a hinge pin. An activator pin is connected to the inner surface of the lower portion. The base portion supports the upper portion and the lower portion by a support rod, one end of which is secured to the base portion and the other end of which is placed in a cavity within the head of the upper portion. The base portion includes a housing with a turning plate secured to its bottom portion, a stationary base with feet spaced below the turning plate, a switch, a battery, a motor, an I.C. Electronic Melody Circuit, a speaker, a drive gear, a cam, a lever arm, a pivot at the middle portion of the lever arm, and gearing which will transmit the motion of the motor to the cam and will cause the turning plate to rotate slowly. When the switch is turned on, the motor turns the cam that in turn activates the lever arm that in turn moves the activator pin that in turn alternately moves the hips of the doll left and right, while the doll slowly turns counterclockwise and a Hawaiian melody is heard.

6 Claims, 10 Drawing Figures

DANCING HULA DOLL

BACKGROUND OF THE INVENTION

1. Field of Invention

This invention relates to hula dolls.

2. Description of the Prior Art

Present hula dolls are not lifelike as they do not move their hips. My invention provides a dancing hula doll that shakes her hips so that she is lifelike.

3. Disclosure Statement

I am not aware of any hula doll which alternately shakes its hips from left to right to give it a lifelikeness that compares with a real hula dancer.

SUMMARY OF THE INVENTION

This invention relates to a hula doll which alternately moves its hips left and right to give a lifelikeness that compares with a real hula dancer. A battery operated motor turns a cam that in turn activates a lever arm that moves the hips of a hula doll left and right alternately, while it slowly rotates and a melody is heard.

An object of this invention is to provide a hula doll which alternately moves its hips left and right.

Another object of this invention is to provide a hula doll which becomes a hula dancer when power is turned on.

A further object of this invention is to provide a hula doll that is more lifelike than present day hula dolls.

Still another object of this invention is to provide a hula doll that alternately moves its hips left and right at the same time it is slowly turning and a melody is heard.

Other objects, features and advantages of the present invention will be readily apparent from the following detailed description taken in connection with the accompanying drawings.

DESCRIPTION OF THE PREFERRED EMBODIMENT

Figure 1:
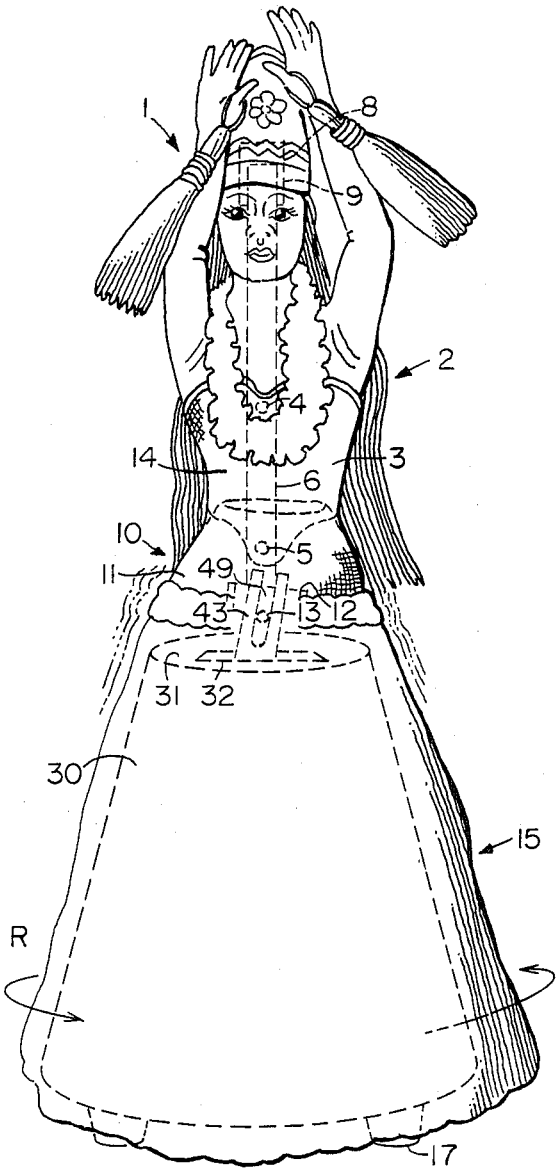
FIG. 1 is a front elevational view of the dancing hula doll.
Figure 2:
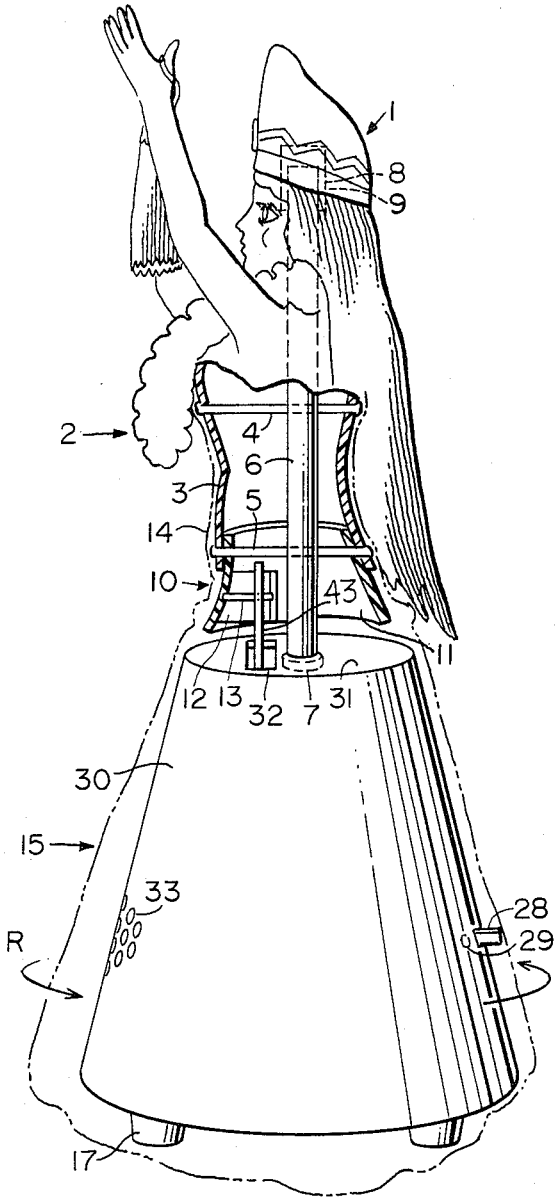
FIG. 2 is a left elevational view of the dancing hula doll with a partial cutaway view of the upper portion of the body and clothing shown in dotted lines.

Before explaining the present invention in detail it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings wherein like reference letters and numerals refer to like and corresponding parts throughout the several views, the preferred embodiment of the invention disclosed in FIGS. 1–10 inclusive is a dancing hula doll 1. Dancing hula doll 1, hereinafter called "Doll", includes an upper portion 2, a lower portion 10, and a base portion 15. Clothes 14 cover doll 1.

Upper portion 2 resembles the head through waist of a human. Lower portion 10 resembles the waist through hip portion of a human. The upper portion 2 and lower portion 10 overlap at the waist area and are pivotally connected to each other by a hinge pin 5. Base portion 15 supports the upper portion 2 and lower portion 10 by a support rod 6, one end of which is secured to top 31 of base portion 15 by a screw 7 and the other end is placed in a cavity 9 within the head of upper portion 2. Lower portion 10 is spaced from top 31 a predetermined distance to allow the alternate movements of hips 11 to left and to right. See FIGS. 1–4.

Upper portion 2 includes torso 3, pin 4, hinge pin 5, padding 8, and cavity 9. Pin 4 and hinge pin 5 pass through support rod 6 in order to stablize it.

Lower portion 10 includes hips 11, bracket 12, and activator pin 13. Bracket 12 is attached to the inner surface of lower portion 10. One end of activator pin 13 is attached to the inner surface of lower portion 10 and the other end is attached to bracket 12. See FIG. 2.

Base portion 15 includes support rod 6, screw 7, stationary base 16 with feet 17, opening 18*a*, and recess 19, screw 18, turning plate 20, bearing supports 21, shaft housing 22, rotating shaft 23, square key 24, screws 25, battery case 26, battery door 27, switch 28, screws 29, housing 30, top 31, slot 32, speaker holes 33, sound panel 35, I.C. Electronic Melody Circuit 36, speaker 37, motor drive and gear box assembly 38, motor drive and gear box 38*a*, motor 39, drive gear 40, gears 41, 41*a*, 41*b*, and 41*c*, cam 42, gears 42*a*, 42*b*, 42*c*, and 42*d*, lever arm 43, slot 32, eccentric 45, nuts 46, washer 47, pivot hole 48, slot 49, screw 50, spacer 51, plates 52 and 53, gears 54, 54*a*, 55, 55*a*, 56, and 57, shafts 55*b* and 56*a*, and shaft housing 58.

Screw 18 secures square key 24 to stationary base 16. Screws 25 secure turning plate 20 to housing 30. Screws 29 secure switch 28 to housing 30. Eccentric 45, nuts 46, and washer 47 are used to movingly secure lever arm 43 to cam 42. Screw 50 pivotally connects lever arm 43 through pivot hole 48 to spacer 51. Screw 50 is screwed into plates 52 and 53, which are secured to the sides of motor drive and gear box 38*a*.

Eccentric 45 is a screw which is located off center of cam 42 so that the circular motion of cam 42 may be converted into left-and-right motion of lever arm 43. Screw 50 serves as a pivot for lever arm 43.

The gears are arranged so that the motion of motor 39 is transmitted to cam 42 and gear 55 for the purpose of causing lever arm 43 to move alternately left and right and causing turning plate 20 to rotate.

Battery within battery case 26 is not shown. Wiring from battery to switch 28 and from battery to I.C. Electric Melody Circuit 36 are not shown for the sake of clarity.

Figure 6:
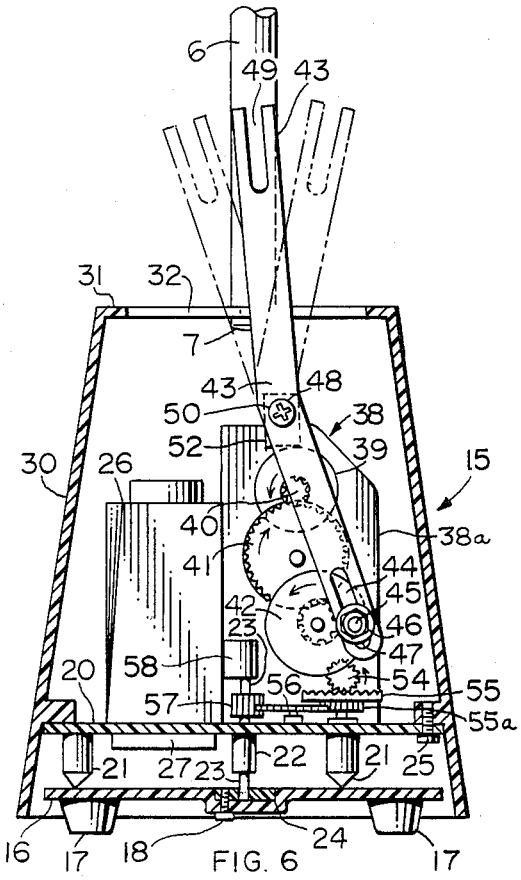
FIG. 6 is an enlarged sectional view taken on line 6—6 of FIG. 5.
Figure 5:
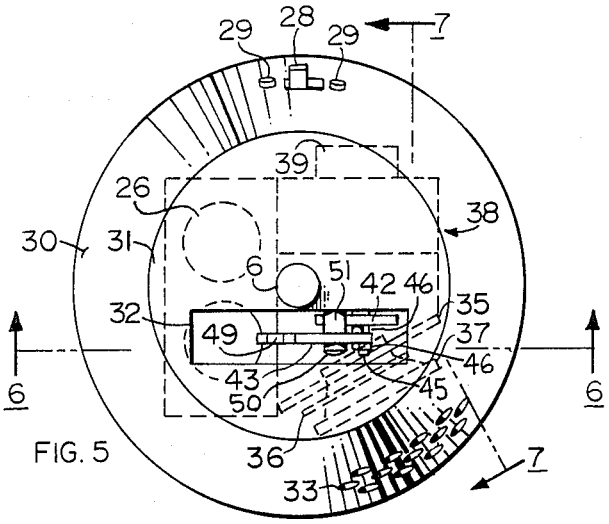
FIG. 5 is a top plan view of the base portion.
Figure 7:
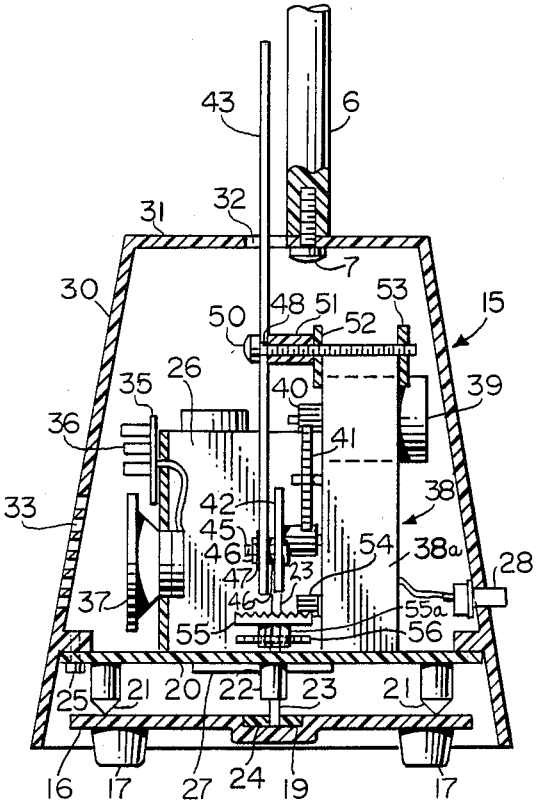
FIG. 7 is an enlarged sectional view taken on line 7—7 of FIG. 5.
Figure 8:
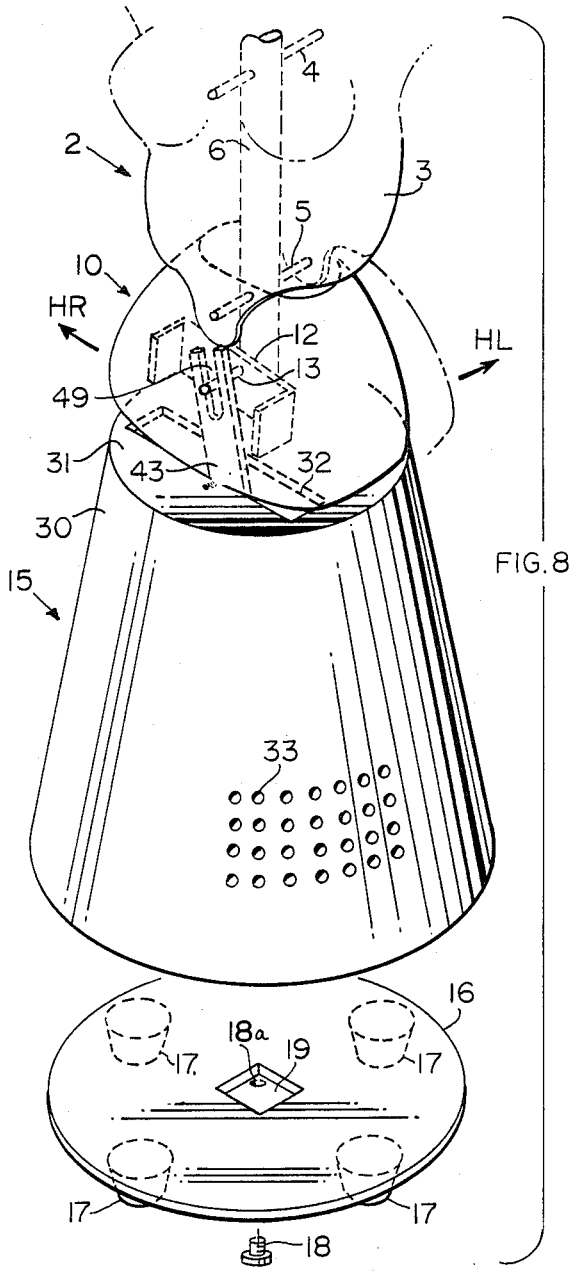
FIG. 8 is a partial perspective, explosive view of the dancing hula doll.
Figure 9:
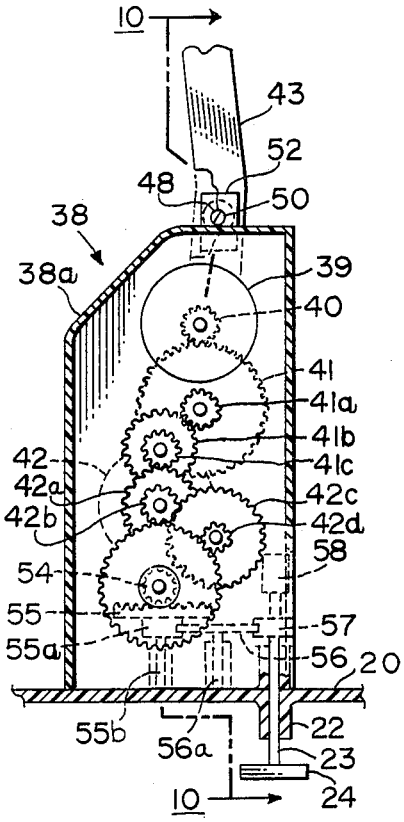
FIG. 9 is an enlarged sectional view taken on line 9—9 of FIG. 10. It is a cutaway rear elevational view of motor drive and gear box.
Figure 10:
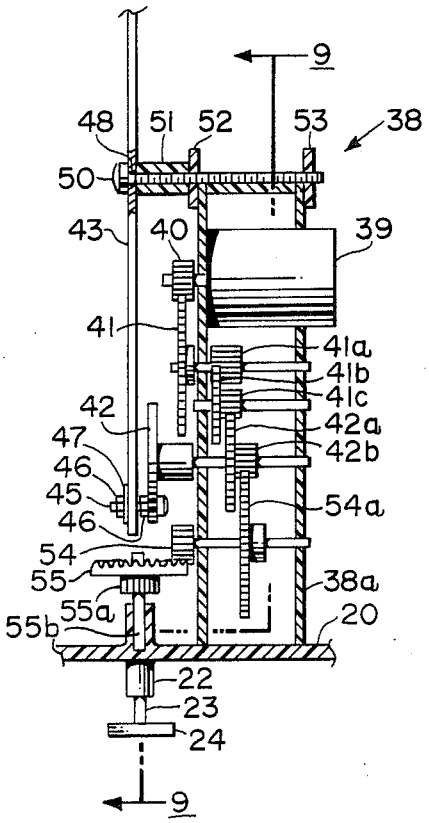
FIG. 10 is an enlarged sectional view taken on line 10—10 of FIG. 9. It is an enlarged fragmentary view of FIG. 7 with the motor drive and gear cutaway to show the gearing in detail.

Reference letter R denotes rotation and the curved arrows nearby show the direction of rotation. Reference letters HR denote hip right and the arrow below them shows the direction of movement. Reference letter HL denote hip left and the arrow below them shows the direction of movement. Four arrows in FIG. 6 show the direction of rotation of respective gears. Arrows near lever arm 43 in FIGS. 3 and 4 denote the direction of movement of activator pin 13.

Figure 3:
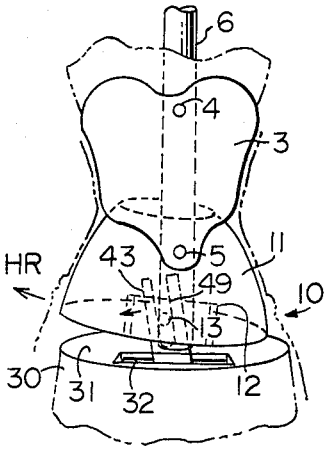
FIG. 3 is a fragmentary front elevational view of upper portion, lower portion, and base portion, showing the hips moved to the right.
Figure 4:
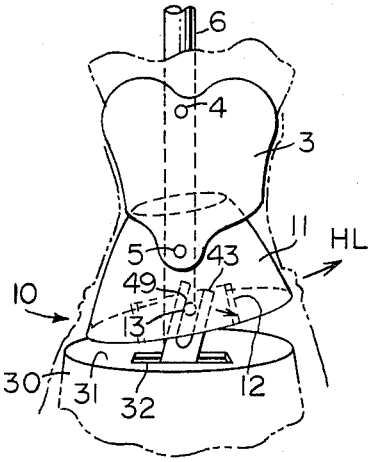
FIG. 4 is a fragmentary front elevational view of upper portion, lower portion, and base portion, showing the hips moved to the left.

The operation of my invention is as follows: When power is turned on by switch 28, doll 1 becomes a hula dancer. Motor 39 turns cam 42 that in turn activates lever arm 43 by means of eccentric 45. Lever arm 43 pivots on screw 50 and moves activator pin 13 left and right alternately by means of slot 49. Activator pin 13 alternately moves lower portion 10 to the left and right as shown in FIGS. 3 and 4. While hips 11 of doll 1 is alternately moving left and right, doll 1 is slowly moving in a counterclockwise direction and a Hawaiian melody is heard. Upper portion 2 remains stationary while lower portion 10 alternately moves left and right to give doll 1 a lifelikeness that is missing from present day hula dolls. Thus, I have invented a dancing hula doll which alternately shakes its hips from left to right to give it a lifelikeness that compares with a real hula dancer.

Although but a single embodiment of the invention has been disclosed and described herein, it is obvious that many changes may be made in the size, shape, arrangements, color and detail of the various elements of the invention without departing from the scope of the novel concepts of the present invention.

I claim as my invention:

1. A dancing hula doll comprising:

an upper portion, a lower portion, and a base portion;

the upper portion resembling the head through waist of a human;

the lower portion resembling the waist through hip portion of a human;

a pin pivotably connecting the upper portion to the lower portion;

a support rod supporting the upper portion and the lower portion above the base portion, one end of said support rod secured to the base portion and the other end of said support rod located in a cavity defined by the upper portion;

means to reciprocate the lower portion transverse to said support rod including a motor, a drive gear, a cam, a lever arm, and an activator pin, said drive gear being connected to the shaft of the motor, said cam being operatively connected to the drive gear, one end portion of the lever arm being operatively connected to the cam, the middle portion of the lever arm being connected to a pivot secured to the base portion, a slot defined by the other end portion of the lever arm engaging said activator pin, and the activator pin being connected to the inner surface of the lower portion;

said base portion including a turning plate, a stationary base with feet, gears for turning the turning plate when the motor is running, a switch, circuit means for playing an electronic melody, a speaker, and a battery;

the turning plate is spaced a predetermined distance from the stationary base;

a shaft, one end of the shaft being secured to the central portion of the stationary base and the other end of the shaft being secured to the base portion;

a central opening defined by the turning plate, said shaft passing through said central opening;

said gears being operatively connected to the shaft and to the drive gear;

said switch being connected to said battery;

said circuit means being connected to said battery;

said motor being connected to said battery; and said battery being secured to the turning plate.

2. The dancing hula doll of claim 1, wherein the base portion includes a truncated conical housing with a slot defined by its top and the turning plate is secured within the truncated conical housing adjacent its bottom portion; and speaker holes are located on the outer surface of the housing adjacent the speaker.

3. The dancing hula doll of claim 1, wherein the lower portion is spaced a predetermined distance from the top of the base portion and clothes cover the doll.

4. The dancing hula doll of claim 1, wherein the lower portion is spaced a predetermined distance from the top of the base portion.

5. The dancing hula doll of claim 1, wherein clothes cover the doll.

6. A dancing hula doll comprising:

an upper portion being hollow and resembling the head through waist of a human;

a lower portion being hollow and resembling the waist through hip portion of a human;

a base portion;

pivot means for pivotably connecting the upper portion to the lower portion;

support means for supporting the upper portion and lower portion above the base portion;

one end of said support means being secured to the base portion and the other end of said support means being secured within the upper portion;

means for reciprocating the lower portion transverse to said support means, said means including drive means located within said base portion, a lever arm extending between said base portion and said lower portion, and activating means located in said lower portion;

one end of the lever arm being operatively connected to the drive means;

the other end of the lever arm engaging said activator means;

a stationary base, said base portion being mounted on said stationary base, and said drive means, when activated, rotating said base portion above said stationary base and simultaneously moving the lever arm to engage said activator means and reciprocate the lower portion transverse to the support means.

* * * * *